US005169294A

United States Patent [19]

Barito

[11] Patent Number: 5,169,294

[45] Date of Patent: Dec. 8, 1992

[54] PRESSURE RATIO RESPONSIVE UNLOADER

[75] Inventor: Thomas R. Barito, East Syracuse, N.Y.

[73] Assignee: Carrier Corporation, Syracuse, N.Y.

[21] Appl. No.: 802,971

[22] Filed: Dec. 6, 1991

[51] Int. Cl.[5] ..... F04B 49/00

[52] U.S. Cl. ..... 417/310

[58] Field of Search ..... 417/310

[56] References Cited

U.S. PATENT DOCUMENTS 4,642,034 2/1987 Terauchi ..... 417/310

4,717,314 1/1988 Sato et al. ..... 417/310

*Primary Examiner*—Richard A. Bertsch

*Assistant Examiner*—Alfred Basichas

[57] ABSTRACT

A pressure ratio responsive valve is provided to control a discharge to suction bypass in a scroll compressor. The valve is acted on by suction pressure, discharge pressure and an intermediate pressure. When the compressor is operating at too high of a pressure ratio, the valve is opened to create a discharge to suction bypass.

5 Claims, 2 Drawing Sheets

PRESSURE RATIO RESPONSIVE UNLOADER

BACKGROUND OF THE INVENTION

In a scroll compressor the trapped volumes are in the shape of lunettes and are defined between the wraps or elements of the fixed and orbiting scrolls and their end plates. The lunettes extend for approximately 360° with the ends of the lunettes defining points of tangency or contact between the wraps of the fixed and orbiting scrolls. These points of tangency or contact are transient in that they are continuously moving towards the center of the wraps as the trapped volumes continue to reduce in size until they are exposed to the outlet port. As the trapped volumes are reduced in volume the ever increasing pressure acts on the wrap and end plate of the orbiting scroll tending to axially and radially move the orbiting scroll with respect to the fixed scroll.

Radial movement of the orbiting scroll away from the fixed scroll is controlled through radial compliance. Eccentric bushings, swing link connections and slider blocks have all been disclosed for achieving radial compliance. Each approach ultimately relies upon the centrifugal force produced through the rotation of the crankshaft to keep the wraps in sealing contact.

Axial movement of the orbiting scroll away from the fixed scroll produces a thrust force. The weight of the orbiting scroll, crankshaft and rotor may act with, oppose or have no significant impact upon the thrust force depending upon whether the compressor is vertical or horizontal and, if vertical, whether the motor is above or below the orbiting scroll. Also, the highest pressures correspond to the smallest volumes so that the greatest thrust loadings are produced in the central portion of the orbiting scroll but over a limited area. The thrust forces push the orbiting scroll against the crankcase with a large potential frictional loading and resultant wear. A number of approaches have been used to counter the thrust forces such as thrust bearings and a fluid pressure back bias on the orbiting scroll. Discharge pressure and intermediate pressure from the trapped volumes as well as an external pressure source have been used to provide the back bias. Specifically, U.S. Pat. No(s). 3,600,114, 3,924,977 and 3,994,633 disclose utilizing a single fluid pressure chamber to provide a scroll biasing force. This approach provides a biasing force on the orbiting scroll at the expense of very large net thrust forces at some operating conditions. As noted, above, the high pressure is concentrated at the center of the orbiting scroll but over a relatively small area. If the area of back bias is similarly located, there is a potential for tipping since some thrust force will be located radially outward of the back bias. Also, with the large area available on the back of the orbiting scroll, it is possible to provide a back bias well in excess of the thrust forces.

Depending upon the conditions of the system in which it is located, a compressor can be subject to various pressure and temperature conditions. Depending upon the operating pressure and temperature conditions, a compressor may run at a higher pressure ratio than design. Loss of charge, condenser fan failure, heat pump extremes are conditions that can produce an excessively high pressure ratio. Running at high pressure ratios can cause excessive wobbling of the orbiting scroll and high discharge temperatures which can result in excessive thrust face wear.

SUMMARY OF THE INVENTION

A discharge to suction bypass is provided and is controlled by a valve. The valve is acted on by intermediate pressure as well as the suction and discharge pressures acting on differential areas.

It is an object of this invention to prevent a scroll compressor from running at high pressure ratios outside of the design operating envelope.

It is another object of this invention to limit the time a scroll compressor can run at excessively high pressure ratios. These objects, and others as will become apparent hereinafter, are accomplished by the present invention.

Basically, intermediate pressure acts on a differential area valve to block a discharge to suction bypass. An opening bias is provided by discharge pressure acting on a differential area. Suction pressure also acts on a differential area but, since it acts on an area opposing intermediate pressure, it merely serves to determine the net pressure differential acting over that area.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
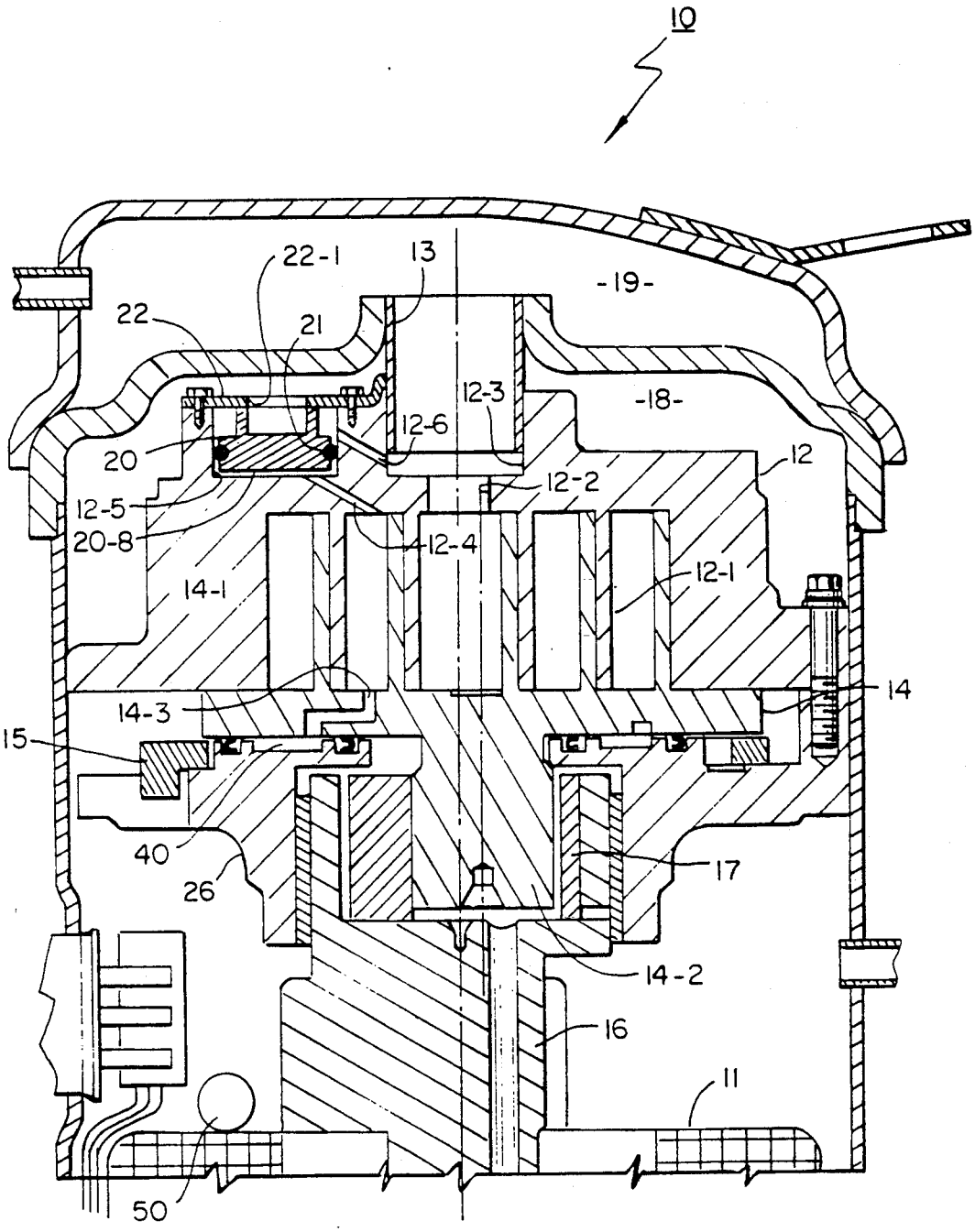
FIG. 1 is a partial, vertical sectional view of a scroll compressor employing the present invention.

In FIG. 1, the numeral 10 generally designates a vertical, low side hermetic scroll compressor having a fixed scroll 12 and an orbiting scroll 14. Fixed scroll 12 has a wrap 12-1, a discharge port 12-2 which is in fluid communication with bore 12-3, bleed passage 12-4 extending from an intermediate pressure zone to bore 12-5, and bypass 12-6 extending from bore 12-3 to bore 12-5. Valve 20 is reciprocatably located in bore 12-5. Bore 12-5 is overlain by valve seat 22 which has a port 22-1 leading to suction plenum 18. Orbiting scroll 14 has a wrap 14-1 and a boss 14-2 which is operatively connected to crankshaft 16 via slider block 17. Orbiting scroll 14 is supported by crankcase 26, and coacts therewith to define axial compliance structure.

Figure 3:
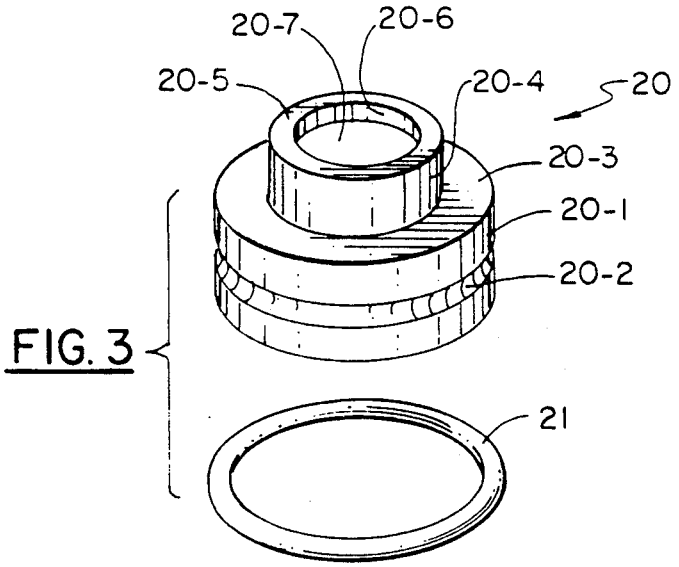
FIG. 3 is an exploded pictorial view of the valve of the present invention.

Referring now to FIG. 3, it will be noted that valve 20 has a first cylindrical portion 20-1 having a groove 20-2 which receives O-ring seal 21. O-ring seal 21 is located between bleed passage 12-4 and bypass 12-6 such that it coacts with bore 12-5 to prevent fluid communication therebetween. First cylindrical portion 20-1 has an annular area 20-3 ($A_3$) with second cylindrical portion 20-4 extending therefrom. Second cylindrical portion 20-4 has a shallow recess defined by bore 20-6 and circular area 20-7 ($A_2$) with bore 20-6 being surrounded by annular area 20-5 which seats on valve seat 22. Referring now to FIG. 1, it will be noted that first cylindrical portion 20-1 has an end defined by circular area 20-8 ($A_1$).

In operation of the FIG. 1 device, orbiting scroll 14 is driven by a motor 11 through crankshaft 16 and slider block 17 and is held to an orbiting motion by Oldham coupling 15. As orbiting scroll 14 is driven by motor 11, wraps 12-1 and 14-1 coact to draw gas from suction plenum 18 and to compress the gas which then serially passes through discharge port 12-2, bore 12-3 and discharge tube 13 into discharge plenum 19. From discharge plenum 19, the hot compressed gas passes to a refrigeration system (not illustrated). The operation described so far is generally conventional. Pressure from an intermediate point in the compression process communicates via passage 14-3 with an annular chamber 40 to provide an axial compliance force. Additionally, pressure from an intermediate point in the compression process is communicated via bleed passage 12-4 to bore 12-5 where it acts against area 20-8 ($A_1$) of valve 20 tending to cause annular area 20-5 to seat on valve seat 22 and surrounding port 22-1. O-ring 21 provides a seal between valve 20 and bore 12-5. Fluid pressure in bore 12-3 communicates with bore 12-5 via bypass 12-6 at a location separated from area 20-8 ($A_1$) by O-ring 21. The fluid pressure supplied to bore 12-5 via bypass 12-6 acts on annular area 20-3 ($A_3$) and tends to unseat valve 20 from valve seat 22. Suction pressure ($P_s$) from suction plenum 18 is supplied via valve port 22-1 to bore 20-6 where it acts on area 20-7 ($A_2$). When compressor 10 is operating within the design envelope, the intermediate pressure ($P_I$) acting on area 20-8 ($A_1$) in combination with the suction pressure ($P_s$) acting on area 20-7 ($A_2$) is sufficient to hold valve 20 seated on valve seat 22 blocking port 22-1 in opposition to discharge pressure ($P_D$) acting on area 20-3 ($A_3$). Areas 20-7 ($A_2$) and 20-3 ($A_3$) are chosen so that valve 20 opens at a given operating pressure ratio thus allowing discharge gas to bypass to the suction plenum 18 of compressor 10 and effectively restrict compressor operation at high pressure ratios. Valve 20 will open when $$P_I A_1 = P_D A_3 + P_s A_2$$

or, where C is a constant that is a function of scroll geometry and the location of bleed passage 12-4 in the compression process, when $$C P_s A_1 = P_D A_3 + P_s A_2$$

or, stated otherwise, the operating pressure ratio $$\frac{P_D}{P_s} = \frac{CA_1 - A_2}{A_3}$$

At any pressure ratio below this condition, valve 20 will remain closed. The pressure acting on annular area 20-5 and the pressure gradient thereacross when valve 20 is seated have been ignored as unduly complicating the description without adding to the understanding of the present invention but must be treated in designing valve 20.

Figure 2:
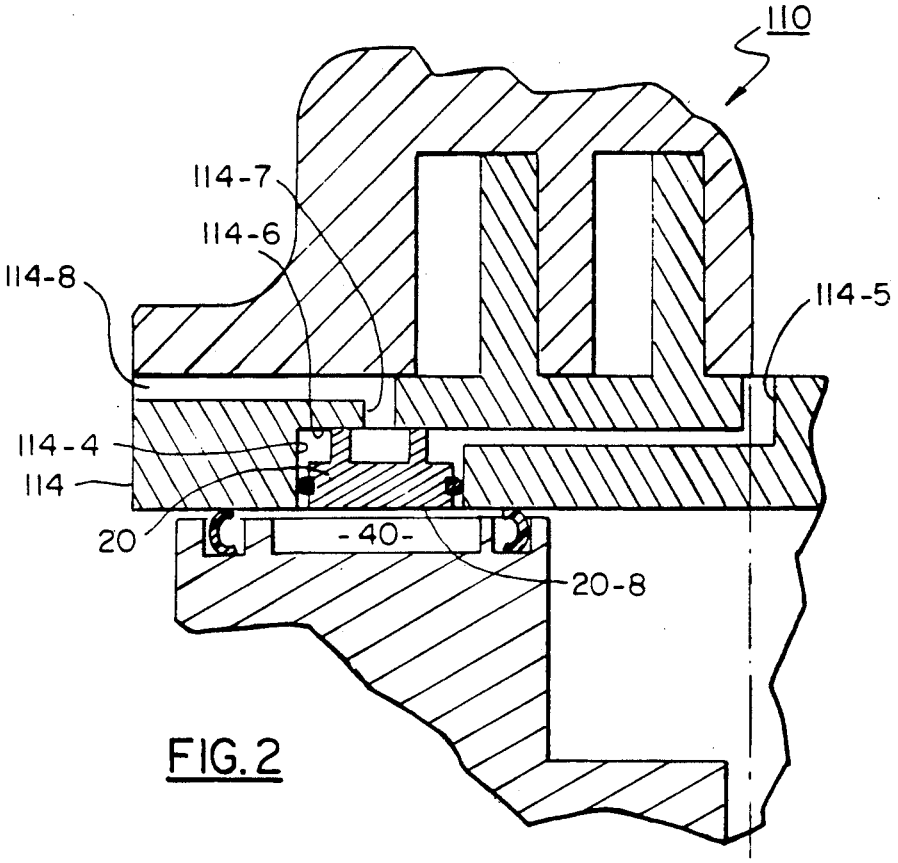
FIG. 2 is a partial, vertical sectional view of a scroll compressor employing a modified arrangement of the present invention.

Referring now to FIG. 2, the FIG. 1 device has been modified by relocating valve 20 to bore 114-4 in orbiting scroll 114 of compressor 110 so that area 20-8 ($A_1$) is exposed to the intermediate pressure ($P_I$) in back chamber 40 of the axial compliance structure. Bypass 12-6 has been replaced by bypass 114-5 and valve seat 22 has been replaced by annular seat 114-6 having valve port 114-7 formed therein. Valve port 114-7 communicates with suction plenum 18 via passage 114-8. Except for relocating valve 20, the embodiment of FIG. 2 functions the same as the FIG. 1 embodiment. Specifically intermediate pressure from axial compliance chamber 40 acts on valve 20 to provide a closing bias opposed by the discharge pressure acting on area 20-3.

When the discharge pressure acting on area 20-3 ($A_3$) is sufficient to unseat valve 20, a discharge to suction bypass will exist which will tend to unload the compressor 10/110. The dynamic balancing of pressures upon opening valve 20, the degree of opening etc. may not be sufficient to fully unload the compressor 10/110. However, in creating the high to low pressure leak within the compressor 10/110 the bypassing of hot high pressure gas will insure that the motor protector 50 heats up quickly and thereby causes compressor 10/110 to shutdown.

Although preferred embodiments of the present invention have been illustrated and described, other changes will occur to those skilled in the art. It is therefore intended that the scope of the present invention is to be limited only by the scope of the appended claims.

What is claimed is:

1. A pressure ratio responsive unloader for a scroll compressor comprising:

a hermetic scroll compressor means having a first scroll, a second scroll orbiting with respect to said first scroll, and a suction plenum;

a valve seat having a valve port in fluid communication with said suction plenum;

valve means;

means for supplying discharge pressure to a first area on said valve means so as to tend to unseat said valve means;

said valve means being movable between a first position seating on said valve seat and a second position spaced from said valve seat and permitting fluid communication between said means for supplying discharge pressure and said suction plenum;

means for supplying intermediate pressure to a second area on said valve means which is larger than and is located so as to be opposing said first area whereby intermediate pressure tends to cause said valve means to be seated so long as a ratio of discharge to suction pressure remains below a selected value.

2. The unloader of claim 1 wherein said valve means is located in said second scroll.

3. The unloader of claim 2 wherein said second area is exposed to a fluid pressure chamber providing axial compliance to said scroll compressor means.

4. The unloader of claim 1 wherein said valve means is located in said first scroll.

5. The unloader of claim 1 wherein said valve means includes a bore, a cylindrical portion sealingly received in said bore, a first end of said cylindrical portion defining said second area, a cylindrical portion extending from a second end of said cylindrical portion so as to define an annular surface which defines said first area, said cylindrical portion having an end which seats on said valve seat when said valve means is closed.

* * * * *